US005675947A

United States Patent [19]

Yane

[11] Patent Number: 5,675,947

[45] Date of Patent: Oct. 14, 1997

[54] INTEGRAL ASTRAGAL

[75] Inventor: Barry Yane, Hampstead, Canada

[73] Assignee: Materiaux de Construction 2 plus 2 Inc., Lachine, Canada

[21] Appl. No.: 634,188

[22] Filed: Apr. 18, 1996

[51] Int. Cl.[6] ..... E05C 7/04

[52] U.S. Cl. ..... 52/207; 49/365; 49/366; 49/368

[58] Field of Search ..... 52/207; 49/365, 49/366, 367, 368, 369

[56] References Cited

U.S. PATENT DOCUMENTS

| | | | |
|---|---|---|---|
| 2,751,639 | 6/1956 | Oswald | 49/366 |
| 4,058,332 | 11/1977 | DiFazio | 292/147 |
| 4,068,433 | 1/1978 | Glover | 52/207 |
| 4,167,088 | 9/1979 | Governale | 52/207 |
| 4,429,493 | 2/1984 | St. Aubin . | |
| 4,502,249 | 3/1985 | Banford . | |
| 4,505,080 | 3/1985 | Sailor | 52/211 |
| 4,573,287 | 3/1986 | Hagemeyer et al. . | |
| 4,644,696 | 2/1987 | Bursk . | |
| 5,193,310 | 3/1993 | Kiel | 49/493.1 X |
| 5,328,217 | 7/1994 | Sanders | 49/367 X |
| 5,335,450 | 8/1994 | Procton | 49/368 |

FOREIGN PATENT DOCUMENTS

| | | | |
|---|---|---|---|
| 1270163 | 4/1972 | United Kingdom | 49/368 |

*Primary Examiner*—Carl D. Friedman
*Assistant Examiner*—Laura A. Saladino
*Attorney, Agent, or Firm*—Swabey Ogilvy Renault; Guy J. Houle

[57] ABSTRACT

An astragal formed as a part of an extruded door sash is described. The astragal is formed integral with the door sash as an elongated forwardly projecting member constituting an astragal base. An elongated detachable cap is releasably secured to the base member and extends forwardly thereof. A core member is disposed internally of the door sash and projects along the outer end edge portion of the sash and at least in part within the astragal. The astragal base member and the door sash form a unitary member.

8 Claims, 4 Drawing Sheets

INTEGRAL ASTRAGAL

TECHNICAL FIELD

The present invention relates to an astragal which is integrally extruded as a part of an extruded door sash to form a unitary member.

BACKGROUND ART

Various astragal structures are known and some of the problems encountered with these is that because they are installed along an outer edge of a stationary door, in a double-door enclosure, they form joints with the outer edge of the stationary door and air and water can infiltrate through such joints. Condensation also forms in these areas in winter months, and ice forms in the joints and causes damage to the astragal member as well as to a sealing compound that may be applied across the joints. Prior art astragals are also time-consuming to install. Furthermore, because the hinge door shuts against an edge of the astragal, it applies forces to the astragal and often loosens its fastener connections to the outer edge of the stationary door. Another disadvantage of many of these astragals is that air infiltrates from the bottom edge of the astragal where a gap is formed between the two doors.

Referring to U.S. Pat. No. 4,502,249, there is shown a typical astragal member which is secured to the edge of a stationary door panel by means of screws secured to an L-shaped leaf of a hinge which secures the hinge door to the panel. As hereinshown the astragal is a wooden piece and a seal is supported in a projecting part of the astragal to abut against the hinge door. This seal is subjected to water infiltration as it is directly open to the outdoors. A gap is also formed between the astragal and the panel.

U.S. Pat. No. 4,644,696 shows a removable astragal which is not attached to any door and which can be removed from across the frame when it is necessary to have a large opening. Again, there is a joint formed with both hinge doors and this results in water and air infiltration.

U.S. Pat. No. 4,429,493 shows an astragal formed of extruded parts which are interconnected together and snapped onto the edge of a door. Again, there are may joints in the astragal structure described herein which causes air and water infiltration. Also, because there are many extruded parts, the tolerances are not always perfect and because these materials expand and contract when exposed to varying temperatures they eventually develop leaks. They also distort with use as the hinge door continuously applies pressure against the astragal abutting edge portion when the hinge door is shut.

U. S. Pat. No. 4,573,287 shows another form of astragal constituted by a wooden piece secured to the end edge of a stationary door and on the front part of which is disposed an extruded astragal. The abutting edge of the astragal is also provided with a seal which is exposed to the outside and consequently develops leaks. The astragal cladding is formed of aluminum and also subjected to thermal contraction.

SUMMARY OF INVENTION

It is a feature of the present invention to provide an astragal integrally formed with the sash of a door and which substantially overcomes the disadvantages of the prior art as hereinabove mentioned.

Another feature of the prior art is to provide an integral astragal and wherein a detachable cap is releasably secured to a base member of the astragal and extends down to the door sill to obstruct water from infiltrating below the astragal joint and the bottom of the joint formed between the stationary and the hinged door.

Another feature of the present invention is to provide an integral astragal which is formed with the door sash by extrusion to provide a unitary member without joints thereby preventing air and water infiltration.

Another feature of the present invention is to provide an astragal having a detachable cap which may have different architectural molding shapes, colors, and which is easily removable and reconnectable.

According to the above features, from a broad aspect, the present invention provides an astragal formed with an extruded door sash. The astragal is an elongated forwardly projecting member formed integral with and along an outer end edge portion of the extruded door sash. A core member is disposed internally of the door sash and disposed along the outer end edge portion thereof and projects at least in part within the astragal. The astragal and the door sash form a unitary member.

According to another broad aspect of the present invention the elongated forwardly projecting member constitutes an astragal base member. An elongated detachable cap is releasably secured to the base member and extends forwardly thereof.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
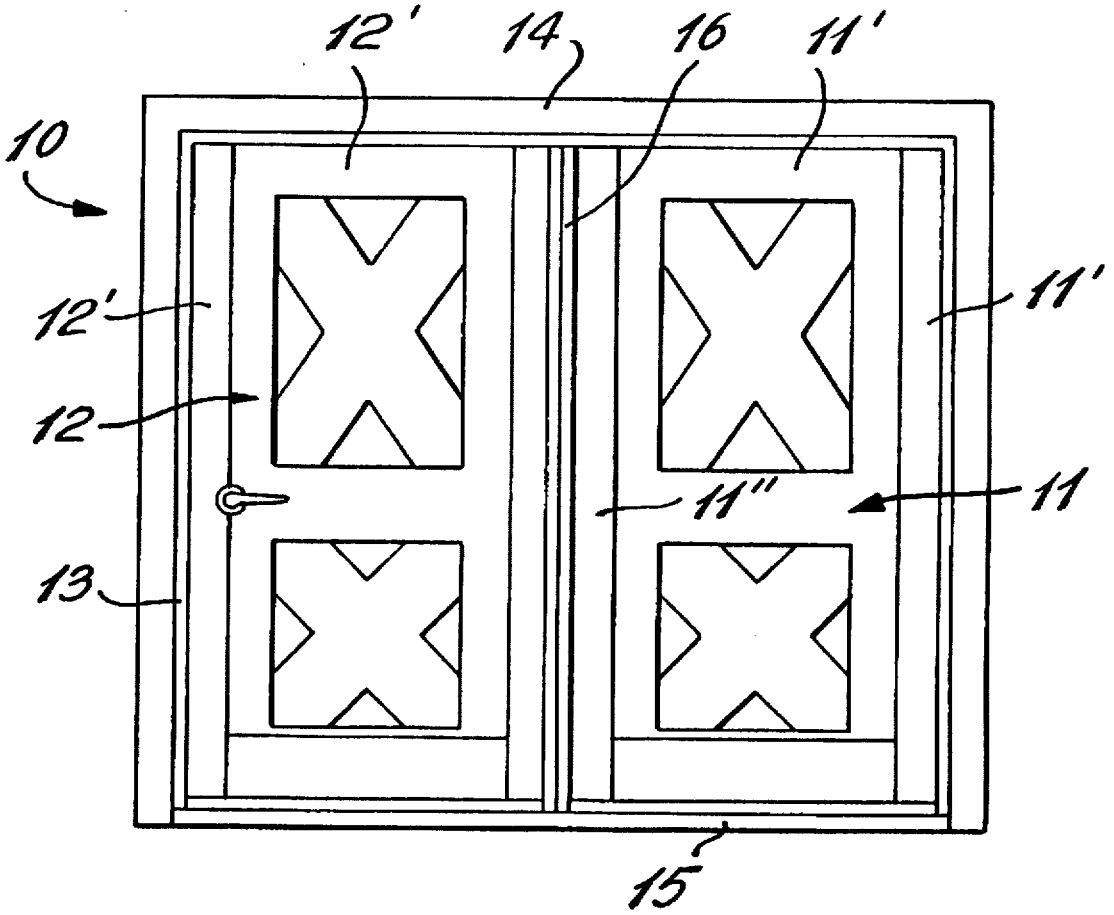
FIG. 1 is an exterior view of a double-door assembly mounted in a door casing and frame having a door sill.

Referring now to the drawings and more particularly to FIG. 1, there is shown generally at 10 a double-door assembly consisting of a stationary door 11 and a hinged door 12 mounted within a door casing 13. A molding 14 is secured about the side and top edge of the door casing. A door sill 15 extends transversely across the lower edge of the door casing. As hereinshown the doors 11 and 12 are formed with plastic extruded door sashes 11' and 12'. The sash 11" of the stationary door 11 is integrally formed with an astragal 16 constructed in accordance with the present invention.

Figure 2:
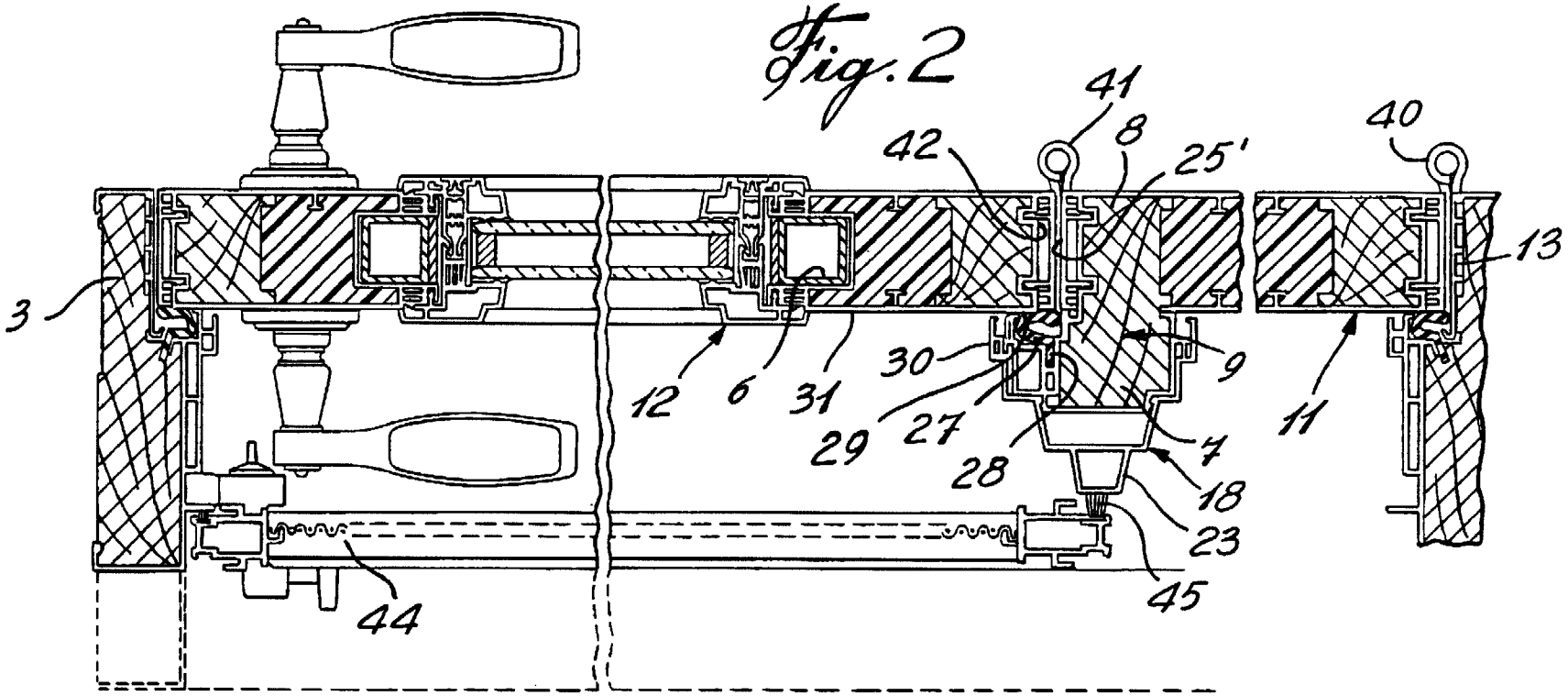
FIG. 2 is a transverse section view showing the integral astragal and door sash secured to a stationary door of a double-door assembly.
Figure 4:
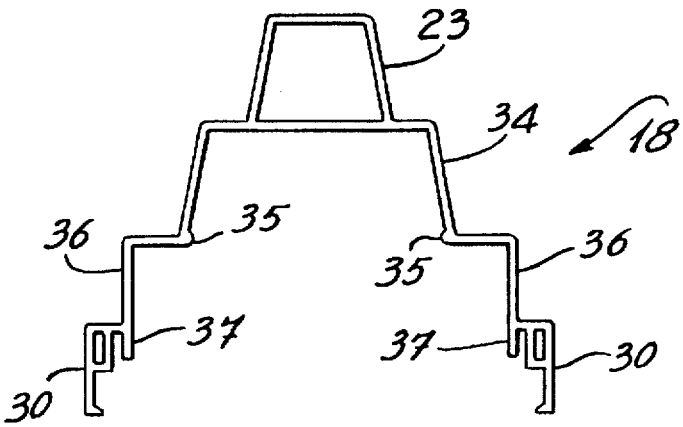
FIG. 4 is a section view showing the construction of the detachable cap member.
Figure 3:
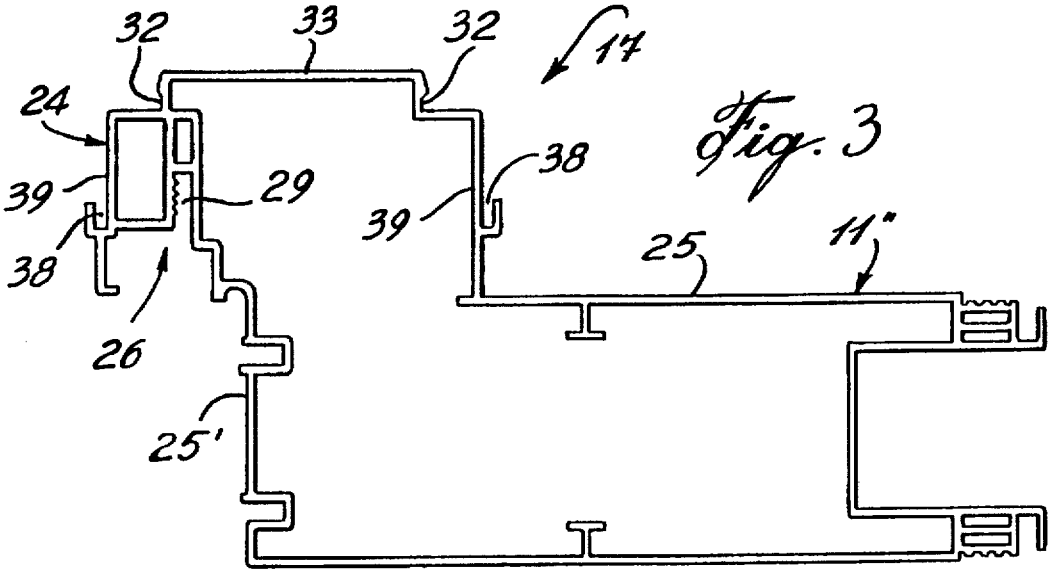
FIG. 3 is a section view of the integrally formed door sash and astragal base member.

With further reference to FIGS. 2 to 4, there will be described the construction of the integral astragal. The astragal 16 comprises an elongated forwardly projecting base member 17 which, as previously described, is formed integral with the sash 11" and therefore both the astragal base and the sash constitute a unitary member with no joints therein thereby preventing any leaks to develop between their interconnection. Because the astragal 16 is substantially all formed with the sash member 11" there is no longer a need to install a separate astragal to the stationary door in a double-door assembly as shown in FIG. 1. The astragal also comprises an elongated detachable cap 18 which is also an extruded part made of plastics material or may even be extruded from aluminum or other materials and is detachably connectable to the base member 17 in a manner which will be described later.

The doors as shown in FIG. 2 are composite doors formed of extruded PVC sections, wood, an insulating foam core and a structural steel inner frame. A core member 9 is secured internally of the door sash 11" and disposed along the outer end edge portion 8 and projects at least in part, as shown at 7 in FIG. 2, within the astragal base member 17. As hereinshown the core is made of wood and receives the door hinge fasteners.

Figure 5:
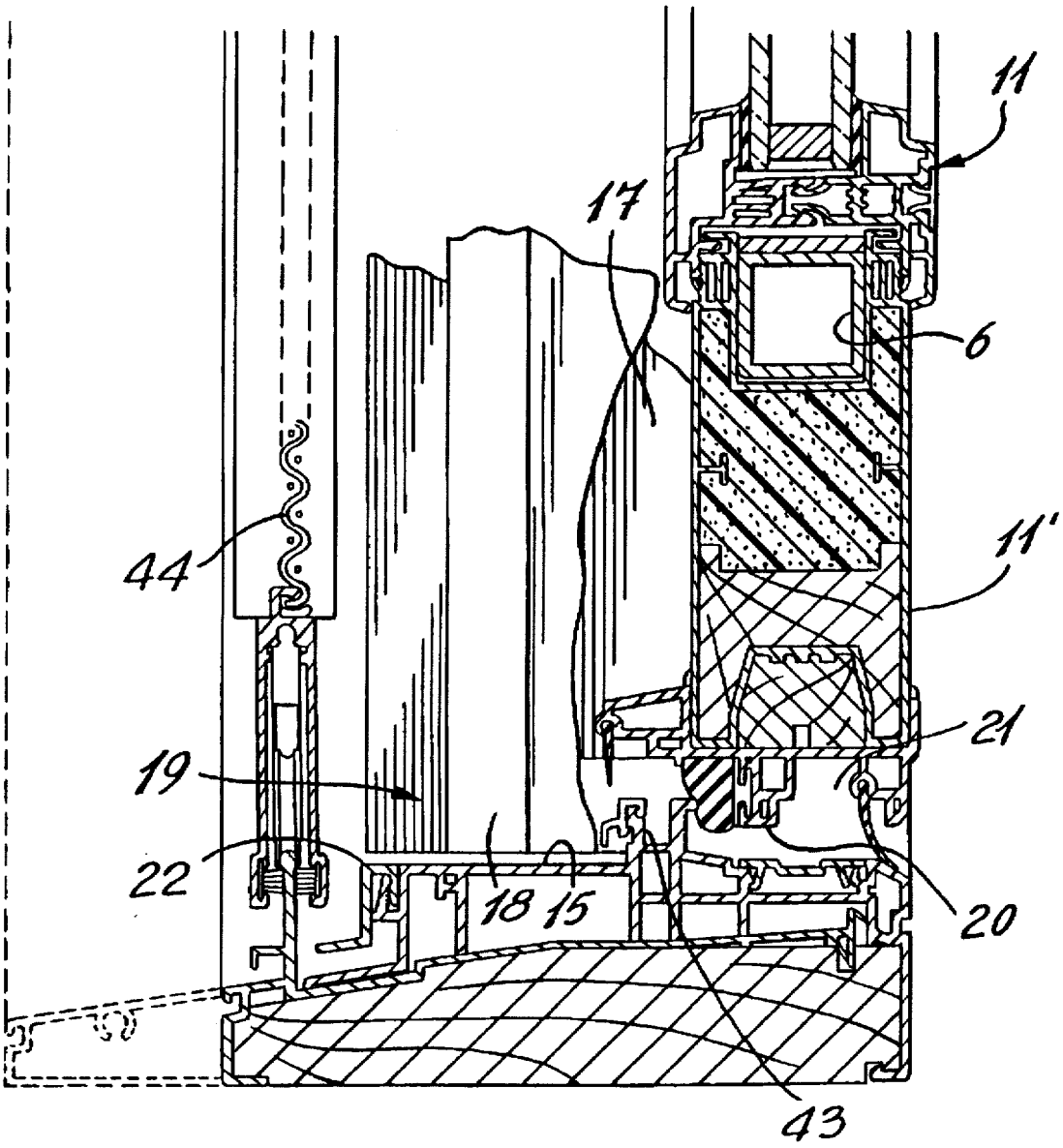
FIG. 5 is a fragmented section view showing the bottom of the door assembly with the position of the astragal cap extending beyond the lower edge of the astragal base member.

Referring to FIGS. 1 and 5, the elongated detachable cap 18 is cut to a predetermined length which is longer than the base member 17 whereby to define a lower extension portion 19 (see FIG. 5) which extends close to the door sill 15 below the lower edge 20 of the stationary door 11 whereby to obstruct the opening 21 formed between the lower edge of adjacent doors in the space between the doors when they are positioned in the same plane in a shut position, as shown in FIG. 1. As also shown in FIG. 5, a gap 22 is formed between the lower edge of the detachable cap and the top face of the door sill 15 to permit a tool, such as a screwdriver, to be placed therein for engagement within the hollow rib 23 which projects forwardly of the detachable cap to permit the astragal cap to be pried out of engagement with the astragal base member 17.

Referring now to FIGS. 2 and 3 it can be seen that the astragal base member 17 has a shoulder portion 24 which extends beyond an outer end wall 25' of the door sash 11" and forwardly of the front face 25 of the sash. A seal receiving cavity 26 is formed integral with the shoulder portion 24 and faces inwardly towards the outer end wall 25'. A weather-proof seal member 27, see FIG. 2, is secured at an engaging end 28 within a toothed internal slot 29 of the cavity 26 to retain the weather-proof seal 27 captive within the cavity 26. The weather-proof seal 27 is disposed all along the astragal base member 17 to abut with a frontal outer end edge 29 of the hinge door 12 when lying in a common plane with the stationary door 11 when shut, as shown in FIG. 2.

As can be seen in FIGS. 2 and 4, the detachable cap 18 is provided with an elongated deflector wall 30 along opposed outer end edge portions thereof and when the cap is connected to the astragal base member, this deflector wall 30 is spaced outwardly from the cavity 26 and close to the outer face 31 of the sash of the hinge door whereby to deflect water or snow away from the seal member thereby protecting the seal from inclimate conditions or water spray when the door is washed. This maintains the seal substantially dry and in good operating condition.

In order to secure the elongated detachable cap to the astragal base member, the base member is provided with a pair of opposed elongated channels 32 formed on opposed sides of a central projecting rib 33. The detachable cap is provided with a pair of opposed flexible frontal side wall portions 34 and having, inwardly of the cap, a pair of opposed and aligned inwardly protruding connecting ribs 35 which are dimensioned to be received in respective ones of the channels 32 and retained therein by a biasing force generated by the side wall portions 34 when they are flexed outwardly to position the ribs 35 within the channels 32. As can be seen, the detachable cap is also provided with opposed rear step side walls 36 each being provided with an internal guide rib 37 for mating engagement in a respective one of opposed guide channels 38 formed adjacent opposed side walls 39 of the astragal base member whereby to prevent the side walls 36 from deflecting outwardly. The integral shape of the cap is therefore retained by its mating engagement with the astragal base member.

It is also pointed out that the shape of the elongated detachable astragal cap may have a different configuration to simulate different types of decorative moldings. It may also be extruded with plastics material having a different color pigment whereby to match door colors. Because the cap is formed of extruded plastics material it is substantially inexpensive and may easily and economically be replaced.

As shown in FIG. 2, the stationary door 11 is secured within the casing 1.3 by hinges 40 secured at an opposed end edge. Both the stationary door 11 and the hinge door 12 are hingedly connected together by the hinges 41 at opposed end walls 25' of the stationary door and end wall 42 of the hinged door. When it is necessary to open both doors of the double-door assembly, it is necessary to remove the elongated detachable cap 18 from the astragal base member whereby the lower extension 19 of the cap 18 does not obstruct with parts of the door sill, such as the channel member 43, as shown in FIG. 5, which extends across the door sill. The stationary door may be provided with connecting means, such as removable brackets (not shown), to secure it within the door casing to make it immovable therein. Such brackets do not, however, form part of the present invention. It should be noted that the bottom end portion of the cap does provide obstruction against hinging the stationary door inwardly of the door casing as this bottom portion would obstruct the channel member 43 provided along the sill. FIG. 2 also illustrates a screen member 44 which is slidingly displaceable between a pair of tracks mounted forwardly of the door frame but not shown herein. As hereinshown the screen, when in its position of use, has a brush seal 45 which engages with the rib 23 of the cap to form a seal with the hinge door opening when the door is open whereby to admit fresh air inside the building enclosure and while preventing bugs or other foreign matter from penetrating the enclosure through the door opening.

It is within the ambit of the present invention to cover any other obvious modifications provided such modifications fall within the scope of the appended claims.

I claim:

1. An astragal formed with an extruded door sash, said astragal comprising an elongated forwardly projecting base member formed integral with and along an outer end edge portion of said extruded door sash, and a core member internally of said door sash and disposed along said outer end edge portion and projecting at least in part within said base member, said astragal and door sash forming a unitary member, an elongated detachable cap releasably secured to said base member and extending forwardly thereof, said elongated detachable cap having a predetermined length which is longer than said base member whereby to define a lower extension which projects close to a door sill and below a lower edge of a stationary door formed with said extruded door sash whereby to substantially obstruct an opening formed between said lower edge and an adjacent lower edge of a hinged door when positioned in the same plane as said stationary door within a door frame to close an opening defined by said frame.

2. An astragal as claimed in claim 1 wherein said astragal base member has a shoulder portion extending beyond an outer end wall of said door sash and forwardly of a front face of said sash, and a seal receiving cavity formed integral with said shoulder portion and facing inwardly towards said outer end wall, a weather-proof seal member retained captive in said seal receiving cavity to provide an elongated seal along a front outer end edge of a hinged door secured to said outer end wall when lying in a common plane.

3. An astragal as claimed in claim 2 wherein said detachable cap is provided with an elongated deflector wall which is spaced outwardly from said cavity and close to an outer face of a sash of said hinged door to deflect water away from said seal member.

4. An astragal as claimed in claim 1 wherein said astragal base member has a pair of opposed elongated channels formed on opposed sides of a central projecting rib, said detachable cap having a pair of opposed and aligned inwardly protruding connecting ribs dimensioned to be received in respective ones of said channels and retained therein by a biasing force generated by opposed flexible frontal side wall portions of said elongated detachable cap.

5. An astragal as claimed in claim 4 wherein said detachable cap is also provided with opposed rear side walls, said rear side walls each having an internal guide rib for mating engagement in a respective one of opposed guide channels found adjacent opposed side walls of said astragal base member.

6. An astragal as claimed in claim 1 wherein said elongated detachable cap is shaped to simulate an outer molding configuration.

7. An astragal as claimed in claim 1 wherein said stationary door is hinged at an opposed end edge to said end edge portion formed with said astragal base member, both said stationary door and said hinged door being hingeable outwardly of said door frame together at said opposed end edge by removing said detachable cap from said astragal base member whereby said lower extension does not obstruct with parts of said door sill.

8. An astragal as claimed in claim 1 wherein said astragal base member and said detachable cap are plastic extruded parts.

* * * * *